United States Patent [19]

Taylor

[11] Patent Number: 5,048,682

[45] Date of Patent: Sep. 17, 1991

[54] SECURITY CASES FOR HAND GUNS

[76] Inventor: Gene D. Taylor, 105 W. Ross Ave., Cincinnati, Ohio 45217

[21] Appl. No.: 527,860

[22] Filed: May 24, 1990

[51] Int. Cl.[5] ..... B65D 85/00

[52] U.S. Cl. ..... 206/317; 224/219; 224/912

[58] Field of Search ..... 206/459, 1.5, 317; 224/219, 222, 218, 912; 340/573

[56] References Cited

U.S. PATENT DOCUMENTS

| | | | |
|---|---|---|---|
| 3,307,755 | 3/1967 | Lentz | 206/317 |
| 3,464,606 | 9/1969 | Nordeen | 224/912 X |
| 3,720,013 | 3/1973 | McDonald | 206/317 X |
| 4,309,065 | 1/1982 | Pappas | 224/912 X |
| 4,466,537 | 8/1984 | McMahan | 206/317 |
| 4,919,037 | 4/1990 | Mitchell | 224/218 X |

*Primary Examiner*—Paul T. Sewell
*Assistant Examiner*—Jacob K. Ackun, Jr.
*Attorney, Agent, or Firm*—Kinney & Schenk

[57] ABSTRACT

A security case is comprised of first and second shells which define a compartment. Means are provided for mounting a hand gun within the compartment. The shells are pivoted to an open position permitting a user to grip the gun and then swung to a closed position in which the user's wrist is captured in an end wall of the case. The shells are latched in their closed position by latching means which can be released by the hand of the user from within the case. Means are provided for mounting a traffic ticket on the case and illuminating it for night time use. Alarm means are provided which are actuated only when the security case is attached on a user's hand and the user is disabled or purposely wants to actuate it.

18 Claims, 2 Drawing Sheets

SECURITY CASES FOR HAND GUNS

The present invention relates to security cases for hand guns.

When a law enforcement officer is in pursuit of a wrongdoer, and has his hand gun drawn, there is always the possibility that he could lose control the gun. This could occur in several ways, as by the officer being taken by surprise and overcome by the wrongdoer. When such an event occurs, the wrongdoer can obtain control of the gun and the officer is subject to being injured, or even killed, by his own gun. Even if the officer is not harmed, his gun falls into the hands of the wrongdoer, who can then use the gun for unlawful purposes.

Accordingly, on object of the present invention is to prevent a law enforcement officer's losing control of his handgun when in pursuit of a wrongdoer.

Another hazard faced by law enforcement officers is in approaching a stopped vehicle on foot. This is a frequently encountered situation in the enforcement of traffic laws, as where a violator is pulled to the side of the road, and the officer then goes to the stopped vehicle to issue a citation, in the form of what is known as a ticket. Inasmuch as the very great number of those who violate traffic laws are, otherwise, law abiding citizens, approaching a stopped vehicle with a drawn hand gun is seldom justified. Even so, there is always the risk, particularly in the night time, that a person in the stopped vehicle would fire upon the officer, before he had the opportunity to draw his own gun.

The hazard continues as the officer is in the process of filling out the ticket, if he remains at the side of the vehicle. In doing so, both of his hands are engaged in the ticket issuing process. With his gun in its holster, the occupant of vehicle has ample opportunity to draw a weapon and fire it at the officer, or to gain control over the officer to effect an escape or other unlawful activity.

Accordingly, a further object of the invention is to enable a law enforcement officer to have his hand gun available for his defense when approaching a stopped vehicle, without undue intimidation.

A further and related object of the invention is to facilitate writing of a ticket by a law enforcement officer, with his hand gun in continued availability for his defense.

Yet another object of the invention is to attain the above ends and further to provide an alarm indicating that the officer is disabled.

A further object of the invention is to facilitate the writing of a ticket during the night time.

These ends are broadly attained by a security case, which is to be attached to the hand of a user to prevent loss of control of the user's hand gun. The security case comprises a first shell, a second shell and means pivotally connecting the shells for swinging movement between an open position and a closed position. The shells, in their closed position, form a compartment, and means are provided for mounting a hand gun therein.

The casing has an opening, formed in at least one of the shells, with which the muzzle of the hand gun is aligned when mounted by the mounting means. The shells have wrist opening, defining portions, which provide a wrist opening when the shells are in their closed position.

The shells, in an open position, permit the hand gun to be grasped by the user's hand with his wrist registered with the wrist opening, defining portions. The shells may then be swung to their closed position with the user's wrist captured in the wrist opening and with the user's hand in a position to fire the hand gun.

The security case may further comprise means for locking the shells in their closed position, which include means for releasing the locking means to permit the shells to be swung to their open position. The means for releasing the locking means is preferably disposed on the interior of the compartment and accessible by the user's hand, inside the compartment, to release the locking means. This prevents removal of the case from the user's hand and access to the gun in the event the user is disabled. The locking means may further comprise a key operated lock accessible from the exterior of the security case.

The security case may further comprise means for securing the case on the person of a user. These means are, preferably take the form of a clip, mounted on one of the shells, which is adapted to engage the belt or waist band of the user.

The security case, in accordance with more specific aspects of the invention may be generally of a rectangular configuration having top and bottom walls, opposed end walls and opposed side walls, the side walls having a length greater than the side walls, with the walls being relatively thin and light weight. The first shell comprises the top wall of the case and portions of end walls and side walls of the case. The second shell comprises the bottom wall of the case and portions of the end walls and side walls of the case. The pivotal connecting means comprise hinge means mounted on the portions of the shells, which form one of the side walls of the case. The wrist opening, defining portions are formed in the end wall portions at one end of the case and the opening with which the gun muzzle is aligned is formed in the other end wall of the case.

Preferably, the wrist opening, defining portions comprise a layer of foam rubber to firmly grip wrists of varying girths. Additionally, the wrist opening, defining portions comprise flanges for minimizing the pressure exerted on a wrist gripped in the wrist opening.

The upper surface of the top wall of the security case may serve to support a ticket and to this end means are provided for clamping a ticket thereon. These means, preferably, comprise a board pivotally mounted on the top wall of the case and a clip for clamping the ticket to the board.

An additional feature is found in providing lamp means for illuminating the ticket when it is clamped by the clip.

The security case may further comprising an alarm device and means for actuating the alarm device in the event the user is disabled.

These means, preferably, include means for sensing a lack of gripping pressure on the hand gun, advantageously in the form of a normally closed, gun switch. Additionally, a normally open, wrist switch may be disposed adjacent the wrist opening. This switch is closed in response to the presence of the user's wrist therein, when the shells are in their closed position. These switches and the alarm device are connected in series with a battery. This arrangement provides for actuation of the alarm device only when the security device is mounted on the hand of a user and the gun switch is released to its closed position because the user is disabled or purposely desires to actuate the alarm.

The above and other related objects and features of the invention will be apparent from a reading of the following description of a preferred embodiment, with reference to the accompany drawings, and the novelty thereof pointed out in the appended claims.

Figure 1:
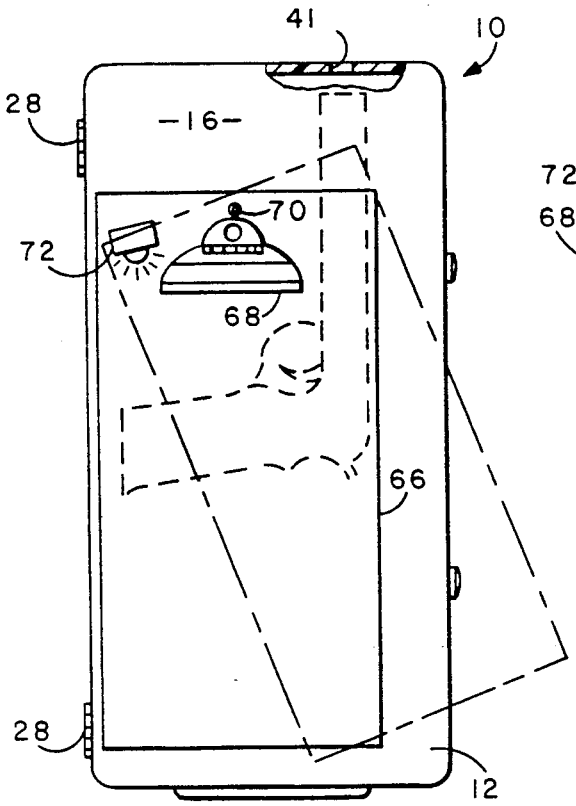
FIG. 1 is a plan view of the present security case.

The present security case, generally identified by reference character 10, preferably, has a generally rectangular configuration, and comprises a top shell 12 and a bottom shell 14. The top shell 12 forms an upper wall 16, end wall portions 18*a*, 20*a*, and side walls portions 22*a*, 24*b*. The bottom shell 14 forms a lower wall 26, end wall portions 18*b*, 20*b*, and side wall portions 22*b*, 24*b*. The shells 12 and 14 are preferably fabricated of a resinous material, commonly referenced as a "plastic" so that the weight of the case 20 will be minimized. Several resinous materials have the structural strength for the protective purposes served by the present case and their selection would be within the abilities of one skilled in the art. Polypropylene is an exemplary material. Also, aluminum could be employed.

It has been found that a case having, approximately, a height of 12 inches and a width of six inches and a depth of six inches (the depth of each of the shells 12 and 14 being three inches) is suitable for the purposes of the present invention.

The shells 12 and 14 are pivotally connected, at their side wall portions 24*a*, 24*b* by a pair of hinges 28. The wall portions (18*a*, 20*a*, 22*a*, 24*a*, and 18*b*, 20*b*, 22*b*, 24*b*) have identical outlines so that, in the closed position of the shells (FIGS. 1 and 2) they compositely form the end and side walls of the case 10.

Figure 3:
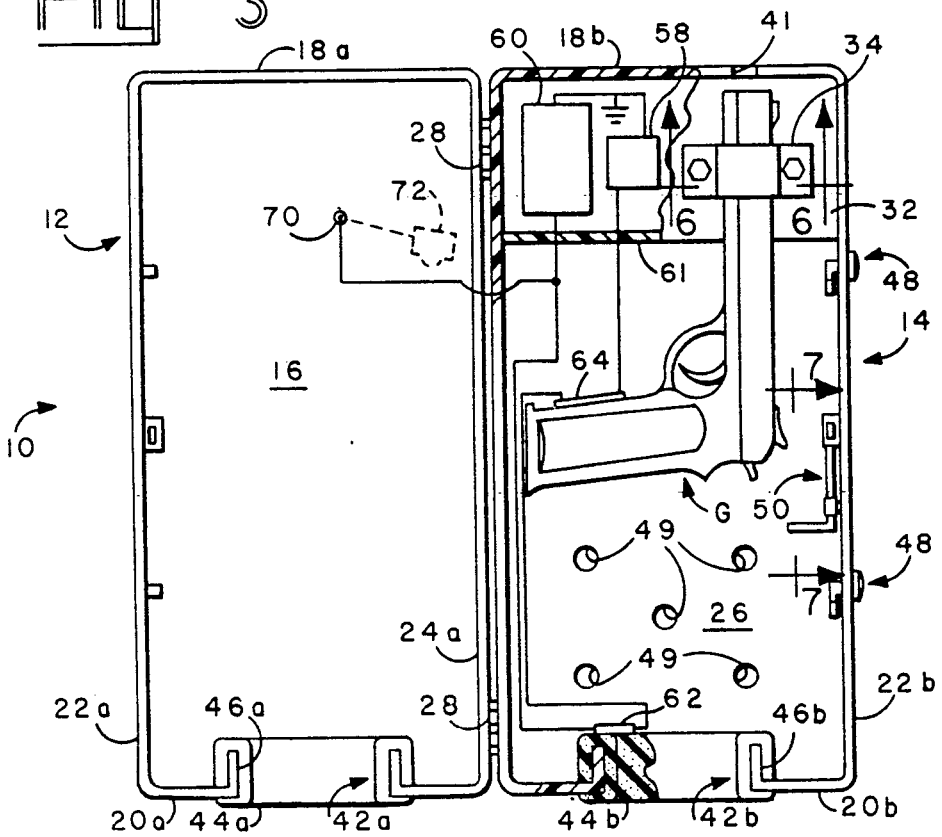
FIG. 3 is a plan view of the security case in an open position.
Figure 4:
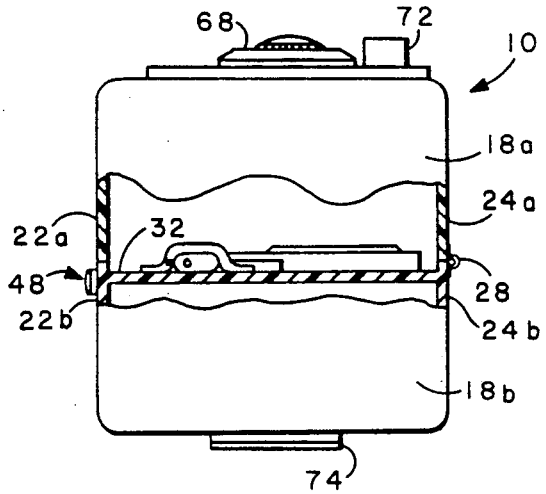
FIG. 4 is an elevation of one end of the security case.
Figure 5:
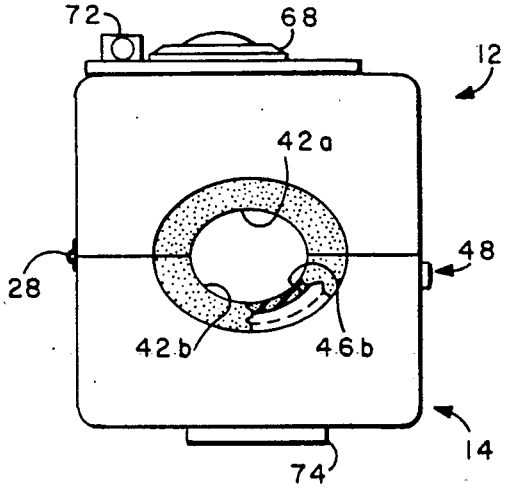
FIG. 5 is an elevation of the opposite end of the security case.
Figure 6:
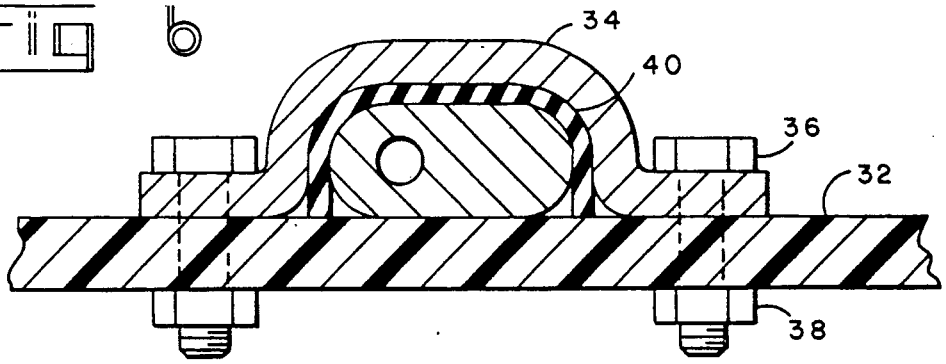
FIG. 6 is a section, on an enlarged scale, taken on line 6—6 in FIG. 3.
Figure 7:
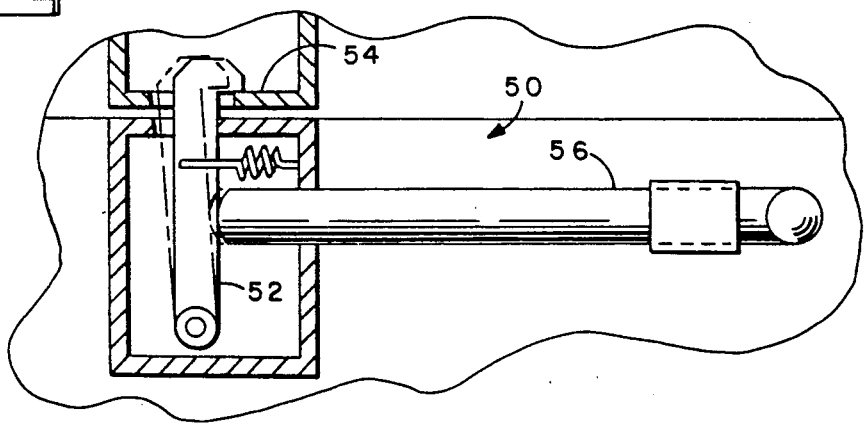
FIG. 7 is a view, on an enlarged scale, taken on line 7—7 in FIG. 3, with the case shells in a closed position.

The closed position of the shells 12, 14 likewise defines an compartment in which a hand gun G is to be mounted. To this end a platform 32 extends between the side wall portions 22*b*, 24*b* and extends to the end wall portion 18*b*, preferably being integrally molded therewith (FIGS. 3, 4 and 6). Means are then provided for clamping the barrel of a handgun G on the platform 32. These means are illustrated as a clamp 34 which is secured by bolts 36 and nuts 38. A resilient gasket 40 may be interposed between the clamp 34 and the barrel of the gun. The gasket 40 protects the gun barrel from being marred. It also serves the function of providing the capability of mounting gun barrels having relatively minor differences in configuration. More extreme variations in cross section would be accommodated by employing an appropriately shaped clamp 40.

The gun G is thus mounted within the case 10 with sufficient clearance for the grip to be grasped and the trigger actuated to discharge a bullet through the end wall formed by portions 14*a*, 14*b*. An opening 41 is formed in the end wall portion 14*b*, or may be compositely formed in that portion and the portion 14*a*.

The end wall portions 20*a*, 20*b*, each have, respectively, semi-elliptical openings, or notches, 42*a*, 42*b*, which, in the closed position of the shells 12, 14, provide a wrist opening. The openings 42*a*, 42*b* are, respectively, lined with sponge rubber gaskets 44*a*, 44*b* and are defined by inwardly projecting flanges 46*a*, 46*b*.

In use a person may grasp the grip of a mounted hand gun G, when the shells are in an open position. It is contemplated that this would be done with the user's left hand. The shell 12 is then swung to a closed position. The shells 12, 14 may then be locked in this closed position by commercially available key lock, latches 48. For added security, the locks 48 may require separate keys for their release.

When the case 20 is thus attached to the hand of a user, his wrist is registered in the wrist opening provided in the end wall portions 20*a*, 20*b*. The thickness of the gaskets 44*a*, 44*b* is sufficient to accommodate wrists of varying girth. The flanges 46*a*, 46*b*, in combination with these gaskets, minimize pressure concentration on the wrist to avoid undue discomfort for the user.

It will be appreciated that when the user has attached the case 10 on his hand, in the fashion described, a high degree of security is provided in that the gun cannot be dislodged from his control and become available to a criminal.

This security is further enhanced by the provision of an interior lock 50 which comprises a latch lever 52 mounted on the side wall portion 22*b* and engages a catch 54 mounted on the side wall portion 22*a*. Latch 52 is yieldingly cammed into engagement with the catch 54 when the shell 12 is swung to its closed position. The user may readily employ his thumb to displace a rod 56 and disengage the latch 52 to open the shell 12, before or after using a key, or keys to open the locks 48. However, in the event that the user were subdued and the key, or keys, for locks 48 became available to a criminal, the criminal would still be denied access to the hand gun G, by reason of the interior lock 50.

Should the shell 12 be swung to a closed position when a user does not have his hand disposed in the case, the lock 50 will automatically be engaged. In such case, a stick may be inserted through the wrist opening to displace the rod 56 and disengage the lock 50 to open the shell 12.

One function of the present security case is to provide protection against loss of the hand gun when in active pursuit of a criminal. In such case, with the security case 20 attached, as above described, the user is protected from loss of control of his gun to a criminal.

Further protection is provided to the user through the provision of alarm means which are activated in the event the user is subdued or otherwise disabled. To this end a beeper, or other alarm device, 58 and a battery 60 are mounted on the shell 14, beneath the shelf 32. A removable panel 61 may be disposed beneath the free end of the shelf 32 to define a compartment for these components. The battery 60 is connected in series with a normally open switch 62, a normally closed switch 64 and the beeper 58. (The wiring for this circuit is diagrammatically illustrated in FIG. 3.) The switch 62 is mounted on or adjacent the wrist gasket 44*b* and is closed when a users wrist is disposed in the wrist opening of the device in its closed or operable position. The switch 64 is mounted on the grip of the hand gun G, as by adhesive tape. When the security case is not in use, the beeper is deenergized because of the normally open switch 62.

When the security case 20 is attached to the hand of a user, the switch 64 is actuated from its normally closed position to an open position, as the grip of the gun is gripped by the hand of the user. The shell 12 is in its closed position, so that the presence of the user's wrist in the wrist opening closes the normally open switch 62. Thus in the normal, or intended use of the security case, the beeper 58 is deenergized because the grip of the user on the gun grip has opened switch 64. However, if the user because disabled and looses his grasp on the gun grip, the switch 64 will close completing the energizing circuit for the beeper 58. An audible alarm is thus provided to indicate that the user is in trouble. The user may also release his grip on the gun to purposely energize the alarm.

Figure 2:
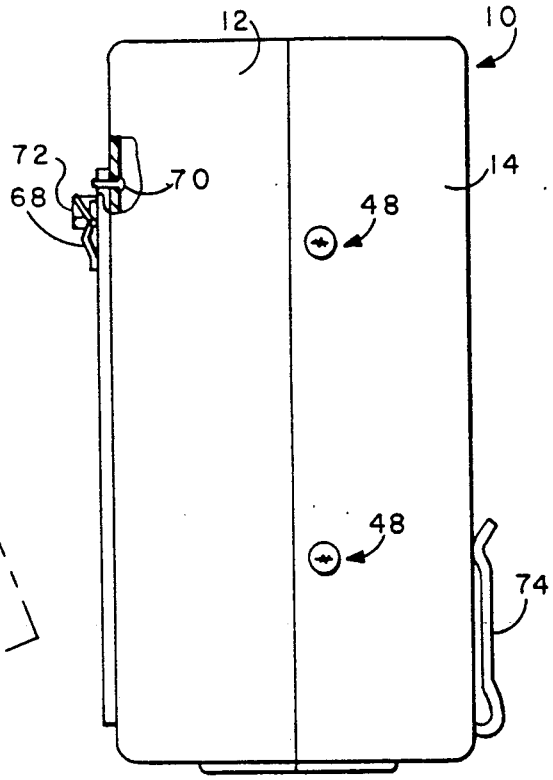
FIG. 2 is a side view of the security case.

Another function of the present security device is enable the user to be in a position to protect himself as he approaches a vehicle with regard to a traffic violation. For this purpose, the security case serves the function of holding a traffic ticket which is to be filled out while the user is at the side of the stopped vehicle. To this end a board 66 is mounted on the top surface of the shell 12. A clip 68 is secured to the upper end of the board 66 to clamp a ticket thereto and facilitate writing of the necessary information. Preferably, the board is pivotally mounted on the shell 12 by a pin 79 which extends through the top wall 16. The board 66 may thus be swung, as indicated in FIG. 1 to a convenient angle to facilitate writing of the ticket information.

A lamp 72 may also be mounted on the clip board to provide illumination for night time use. The lamp 72 may be energized by connections with the battery 60, diagrammatically shown in FIG. 3, extending through the pivot pin 70. An appropriate switch can be provided on the lamp 72, or on the board 66 to turn the lamp on and off.

In either of its intended uses, it is contemplated that the security device will be attached to the person of the user with the shell 12 in an open, ready position. To this end, a clip 74 is provided on the bottom wall 26 of the lower shell 14. The clip 74 is adapted to hook over the user's belt or waist band when the security case is in its ready position. The security case is then readily removable after the security device has been attached to the user's hand. By detachably mounting the security case in this fashion, it is immediately available when the need for its use arises. Further, having the shell 14 anchored to the user's belt, facilitates attaching it to the user's hand, as his other hand is free to swing the shell 12 to its closed position.

Variations from the disclosed embodiment will occur to those skilled in the art within the spirit and scope the present invention. Such variations are to be deemed within the coverage afforded by the following claims.

Having thus described the invention, what is claimed as novel and desired to be secured by Letter Patent of the United States is:

1. A security case to be attached to the hand of a user and prevent loss of control of a hand gun, said security case comprising a first shell, a second shell.

means pivotally connecting said shells for swinging movement between an open position and a closed position, said shells forming, in said closed position, a compartment, means for mounting a hand gun within said compartment, said casing having an opening, formed in at least one of said shells, with which the muzzle of the hand gun is aligned when mounted by the mounting means, said shells having wrist opening, defining portions, which provide a wrist opening when the shells are in their closed position, said shells, in an open position, permitting the hand gun to be grasped by the user's hand with his wrist registered with the wrist opening, defining portions, whereby the shells may be swung to their closed position with the user's wrist captured in said wrist opening and with the user's hand in a position to fire the hand gun.

2. A security case as in claim 1 further comprising means for locking said shells in their closed position, including means for releasing said locking means to permit the shells to be swung to their open position.

3. A security case as in claim 2 wherein the means for releasing the locking means is disposed on the interior of said compartment and accessible by the user's hand, inside the compartment, to release the locking means.

4. A security case as in claim 3 wherein the locking means further comprise a key operated lock accessible from the exterior of the security case.

5. A security case as in claim 1 which further comprises means for securing the case on the person of a user.

6. A security case as in claim 4 which further comprises a clip mounted on one of said shells, which is adapted to engage the belt or waist band of the user and thereby secure the case on the person of the user.

7. A security case as in claim 1 wherein the case is generally of a rectangular configuration having top and bottom walls, opposed end walls and opposed side walls, the side walls having a length greater than the side walls, said walls being relatively thin and light weight, the first shell comprises the top wall of the case and portions of end walls and side walls of the case, and the second shell comprises the bottom wall of the case and portions of the end walls and side walls of the case, the pivotal connecting means comprise hinge means mounted on the side wall portions of said shells, which form one of the side walls of the case, the wrist opening, defining portions are formed in the end wall portions at one end of the case, and the opening with which the gun muzzle is aligned is formed in the other end wall of the case.

8. A security case as in claim 7 wherein the wrist opening, defining portions comprise a layer of foam rubber to firmly grip wrists of varying girths.

9. A security case as in claim 8 wherein the wrist opening, defining portions comprise flanges for minimizing the pressure exerted on a wrist gripped in the wrist opening.

10. A security case as in claim 7 further comprising means for clamping a ticket on the top wall of the case.

11. A security case as in claim 10 wherein the means for clamping the ticket comprise a board pivotally mounted on the top wall of the case and a clip for clamping the ticket to the board.

12. A security case as in claim 10 further comprising lamp means for illuminating the ticket when is clamped by said clamping means.

13. A security case as in claim 1 further comprising an alarm device and means for actuating the alarm device in the event the user is disabled.

14. A security device as in claim 13 wherein the means for actuating the alarm device include means for sensing a lack of gripping pressure on the hand gun, indicating that the user is disabled.

15. A security device as in claim 14 wherein the means for sensing a lack of gripping pressure on the gun comprise a normally closed, gun switch which is adapted for attachment to the grip of the gun, and the means for actuating the alarm further comprise a battery, a normally open, wrist switch disposed adjacent the wrist opening and closed in response to the presence of the user's wrist therein, when the shells are in their closed position, and means connecting said switches and said alarm in series with said battery, whereby, the normally open, wrist switch will prevent actuation of the alarm when the security case is not attached to a user's hand, and the normally open gun switch will be closed by the user when the security case is attached to a user's arm and he is gripping the gun, to the end that the alarm device will only be actuated when the security device is mounted on the user's hand and he is disabled, or intentionally desires to actuate the alarm.

16. A security case as in claim 7 further wherein the means for mounting a hand gun comprise a shelf spaced above the bottom wall, spanning the side wall forming portions of the second shell and secured to the end wall opposite the end wall in which the wrist opening is formed, and means for clamping the barrel of the hand gun to the shelf, said case further comprising a clip mounted on the bottom wall of the case and adapted to engage the belt or waistband of a user to secure the case on the person of the user, means for locking said shells in their closed position, said locking means comprising, comprising latching means mounted on the shell portions which form the side wall of the case opposite the hinge connection, and a rod for releasing said latching means, said rod being displaceable by the user when the case is closed and his hand is therein and also being displaceable by a stick, or the like, inserted through the wrist opening, when the shells are in their closed position.

17. A security case as in claim 16 wherein the locking means further comprise a key operated lock accessible from the exterior of the security case, and the wrist opening, defining portions comprise a layer of foam rubber to firmly grip wrists of varying girths, and the wrist opening, defining portions further comprise flanges for minimizing the pressure exerted on a wrist gripped in the wrist opening.

18. A security case as in claim 17 further comprising a board pivotally mounted on the top wall of the case and a clip for clamping the ticket to the board, lamp means for illuminating the ticket when is clamped by said clamping means, an alarm device disposed beneath said shelf, and means for actuating the alarm device including a battery disposed beneath said shelf, a removable panel extending between said shelf and said bottom wall to define a compartment for the battery and alarm device, a normally closed, gun switch which is adapted for attachment to the grip of the gun to sense a user's gripping pressure on the grip of the gun, a normally open, wrist switch disposed adjacent the wrist opening and closed in response to the presence of the user's wrist therein, when the shells are in their closed position, and means connecting said switches and said alarm in series with said battery, whereby, the normally open, wrist switch will prevent actuation of the alarm when the security case is not attached to a user's hand, and the normally open gun switch will be closed by the user when the security case is attached to a user's arm and he is gripping the gun, to the end that the alarm device will only be actuated when the security device is mounted on the user's hand and he is disabled, or intentionally desires to actuate the alarm.

* * * * *